United States Patent [19]

Thompson

[11] 4,234,411

[45] Nov. 18, 1980

[54] FLUID CATALYTIC CRACKING PROCESS

[75] Inventor: Gregory J. Thompson, Waukegan, Ill.

[73] Assignee: UOP Inc., Des Plaines, Ill.

[21] Appl. No.: 20,771

[22] Filed: Mar. 15, 1979

[51] Int. Cl.[3] ..... C10G 11/18; C10G 37/02

[52] U.S. Cl. ..... 208/74; 208/153; 208/159; 208/164; 208/DIG. 1

[58] Field of Search ..... 208/153, 159, 164, DIG. 1, 208/74

[56] References Cited

U.S. PATENT DOCUMENTS

| | | | |
|---|---|---|---|
| 2,402,875 | 6/1946 | Cornell | 208/74 |
| 2,407,371 | 9/1946 | Jahnig | 208/159 |
| 2,488,030 | 11/1949 | Scheinman | 208/159 |
| 2,593,520 | 9/1952 | Boisture | 208/159 |
| 2,766,185 | 10/1956 | Pansing | 208/159 |
| 3,186,805 | 6/1965 | Gomory | 208/74 |
| 3,440,020 | 4/1969 | Owen | 208/153 |
| 4,026,789 | 5/1977 | James | 208/164 |

*Primary Examiner*—Herbert Levine

*Attorney, Agent, or Firm*—James R. Hoatson, Jr.; John G. Cutts, Jr.; William H. Page, II

[57] ABSTRACT

An improved fluid catalytic cracking process providing improved product yield and selectivity which employs a split flow of recycled, regenerated catalyst to the reactor riser. Process operating temperatures control the flow rates of the recycled, regeneration catalyst.

1 Claim, 1 Drawing Figure

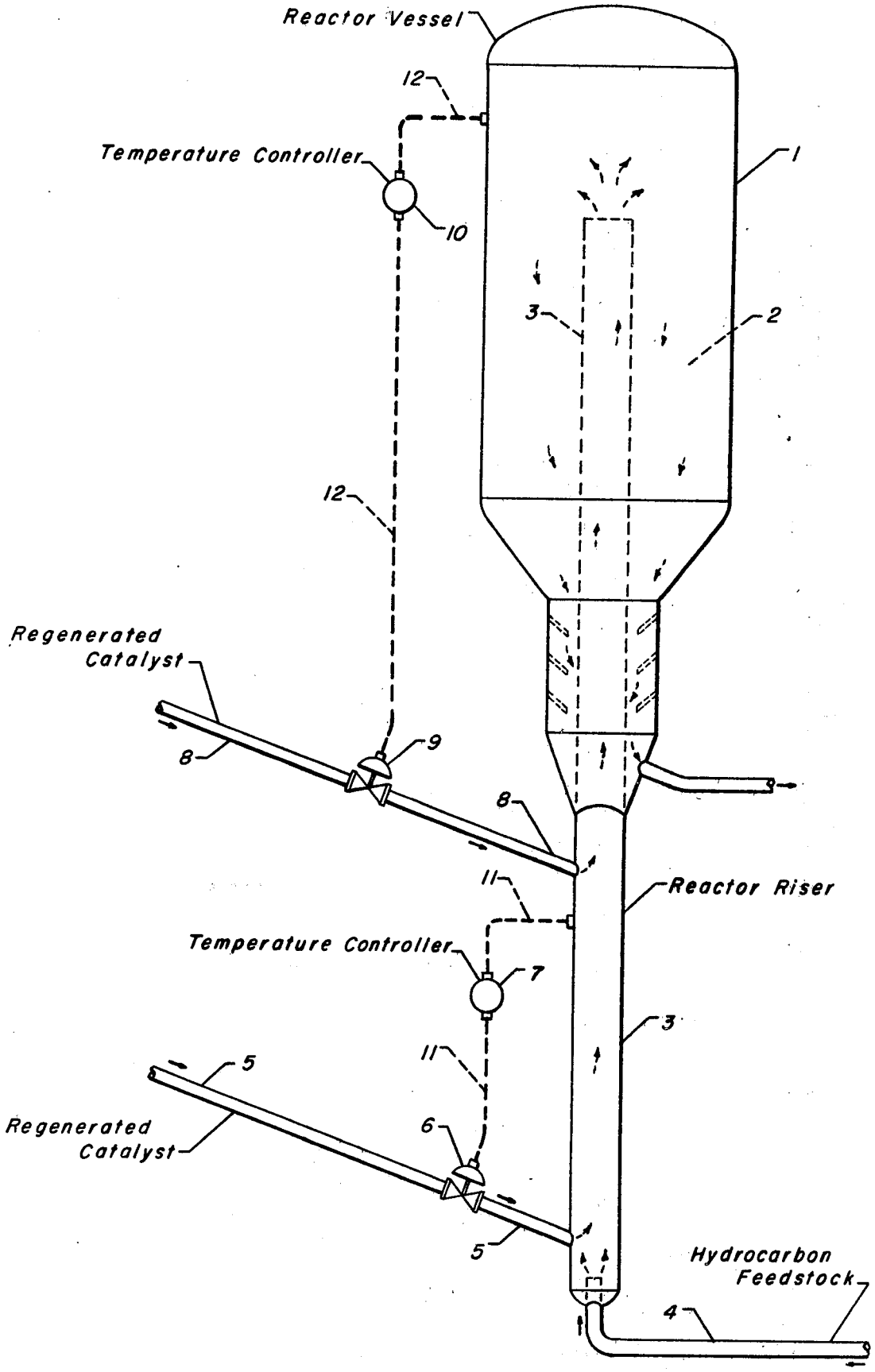
Reactor Vessel
12
Temperature Controller
10
1
3
2
12
Regenerated Catalyst
8
9
8
11
Reactor Riser
Temperature Controller
7
3
11
5
Regenerated Catalyst
6
5
Hydrocarbon Feedstock
4

FLUID CATALYTIC CRACKING PROCESS

BACKGROUND OF THE INVENTION

Catalytic cracking of heavy petroleum fractions is one of the major refining operations employed in the conversion of crude petroleum oils to desirable fuel products such as high-octane gasoline fuels used in spark-ignited internal combustion engines. Illustrative of "fluid" catalytic conversion processes is the fluid catalytic cracking process wherein suitably preheated high molecular weight hyrocarbon liquids and vapors are contacted with hot, finely-divided, solid catalyst particles, either in a fluidized bed reactor or in an elongated riser reactor, and maintained at an elevated temperature in a fluidized or dispersed state for a period of time sufficient to effect the desired degree of cracking to lower molecular weight hydrocarbons typically present in motor gasolines and distillate fuels. Suitable hydrocarbon feeds boil generally within the range from about 400° to about 1200° F. and are usually cracked at temperatures ranging from 850° to 1200° F.

In a catalytic process some non-volatile carbonaceous material, or "coke", is deposited on the catalyst particles. Coke comprises highly condensed aromatic hydrocarbons which generally contain 4–10 wt. % hydrogen. As coke builds up on the catalyst, the activity of the catalyst for cracking and the selectivity of the catalyst for producing gasoline blending stock diminish. The catalyst particles may recover a major proportion of their original capabilities by removal of most of the coke therefrom by a suitable regeneration process.

Catalyst regeneration is accomplished by burning the coke deposits from the catalyst surface with an oxygen-containing gas, such as air. Many regeneration techniques are practiced commercially whereby a significant restoration of catalyst activity is achieved in response to the degree of coke removal. As coke is progressively removed from the catalyst, removal of the remaining coke becomes most difficult and, in practice, an intermediate level of restored catalyst activity is accepted as an economic compromise.

The regenerated catalyst is recycled to contact fresh hydrocarbon feedstock and to convert hydrocarbons to more valuable products.

SUMMARY OF THE INVENTION

This invention relates to an improved fluid catalytic cracking process, including an improved process for the introduction of circulating catalyst into the hydrocarbon feedstock. It has been found that in fluid catalytic cracking processes there may be advantages to having the regenerated, recycle catalyst returned to the riser at more than one locus. In the case where there is only one regenerated catalyst return line to the reactor riser, the flow of catalyst is generally determined by the temperature of the reactor. When more than a single regenerated catalyst return line to the reactor riser is deemed desirable, a single temperature controller cannot regulate the catalyst flow rates independently.

I have discovered that a first stream of regenerated catalyst to the reactor riser may suitably be regulated by the temperature in the reactor while a second stream of regenerated catalyst may suitably be regulated by a reactor riser temperature having a locus intermediate said first and second stream of regenerated catalyst.

DESCRIPTION OF THE DRAWING

The drawing illustrates the preferred embodiment of the invention and is an elevational view of apparatus suitable for the flow control of regenerated catalyst in a catalytically cracking process according to the process of the present invention.

A hydrocarbon feed stream, such as a vacuum gas oil or reduced crude, enters through line 4 and passes into reactor riser 3. A first portion of regenerated catalyst enters through line 5, passes through control valve 6 and enters reactor riser 3. The feedstock from line 4 and regenerated catalyst from line 5 are admixed in the reactor riser 3 and pass upwardly through riser 3. The admixture of catalyst and hydrocarbon feedstock, which upon contact begin hydrocarbon conversion reactions, passes by a temperature measurement and control means 7 which is incorporated into riser 3. Temperature measurement and control means 7 generates a signal transmitted through means 11 to control valve 6. The admixture of catalyst and hydrocarbon continues to pass upwardly to where a second portion of regenerated catalyst enters through line 8, passes through control valve 9 and enters reactor riser 3 to meet the flowing first portion of catalyst and hydrocarbon. The admixture of catalyst and hydrocarbons passes through reactor riser 3 into reactor vessel 1 which has interior space 2. Reactor vessel 1 has a temperature measurement and control means 10 which generates a signal transmitted through means 12 to control valve 9.

DETAILED DESCRIPTION

In the processing of hydrocarbons in fluid catalytic cracking processes, recent advances in catalyst development and the requirement to attempt to process more exotic and unconventional sources of hydrocarbons such as, for example, reduced crude, coal derived oil, oil shale, to tar sand and derived oil, require that the conventional fluid catalytic cracking processes be modified to satisfactorily utilize these most readily available catalysts and feedstocks. One method which may be a desirable modification of the conventional fluid catalytic cracking process is to have multiple regenerated catalyst inlets to the reactor riser which poses the problem of how to control the catalyst flow rates through each catalyst recycle line. I have discovered that a suitable method for such control comprises regulating a first stream of regenerated catalyst to the reactor riser with a signal derived from the temperature in the reactor and then regulating a second stream of regenerated catalyst to the reactor riser with a signal derived from a reactor riser temperature having a locus intermediate said first and second stream of regenerated catalyst.

The preferred embodiment of the invention is illustrated in the drawing. The following initial description of the invention will be set only in terms of the preferred embodiment. Other embodiments of the invention, which consist of measuring system temperatures and controlling regenerated catalyst flow rates, will then be described. Although only two regenerated catalyst supply lines to the reactor riser are shown, the invention may be applied to a process having three or more catalyst supply lines.

Accordingly, a broad embodiment of the present invention may be characterized as a method for controlling the flow rate of two or more streams of regenerated catalyst in a fluid catalytic cracking process. A more particular embodiment of the invention is a process for catalytically cracking hydrocarbonaceous feedstock wherein fluidizable cracking catalyst which has been deactivated with coke deposits is withdrawn from the cracking reaction zone, stripped of volatile material, passed to a regeneration zone, and recycled after regeneration to the reaction zone, the method comprising: (a) contacting said feedstock with at least a portion of said recycled, regenerated catalyst which catalyst has a flow rate responsive to a first temperature located downstream from the point where the feedstock contacts said first portion of recycled regenerated catalyst; and (b) contacting said feedstock combined with said first portion of recycled, regenerated catalyst with a second portion of recycled, regenerated catalyst which catalyst has a flow responsive to a second temperature located downstream from the point where the feedstock contacts said second portion of recycled, regenerated catalyst.

Any of the required temperature measurements, such as for example the temperature of the reactor riser or the reactor vessel may be determined by a thermocouple placed in the appropriate location. Those skilled in the arts of flow control and hydrocarbon processing will recognize that there exists a wide variety of equipment which may be used as the various elements of the system.

The temperature measuring means will most likely be a thermocouple. The signals generated by measuring means can be transmitted by any method but will generally be accomplished either electrically or pneumatically to the various control elements. The operational signals provided by these control means may also be transmitted in either mode. The control elements themselves may comprise a pneumatic controller, a digital electronic system, an analog electronic system or a fluidic system. The control means may utilize proportional, integral and derivation modes, and they may be designed to provide either closed loop or open loop response. Those skilled in the art will recognize advantages which may be derived from the application of feedback or feed forward control loops.

The valve means used to control the flow of regenerated catalyst into the reactor riser may be any of the many types available including gate, globe, plug, butterfly and diaphragm valves and hybred combinations thereof. However, the preferred valve means are specilized gate valves which are also known as fluid catalytic cracker slide valves.

The foregoing demonstrates the method by which the present invention is effected and the benefits afforded through the utilization thereof.

I claim as my invention:

1. A process for catalytically cracking a hydrocarbonaceous feedstock wherein fluidizable cracking catalyst that has become deactivated with coke deposits is withdrawn from a hydrocarbon cracking reaction zone, stripped of volatile material, passed to a regeneration zone for removal of said coke deposits and recycled thereafter in divided streams to a reactor riser situated upstream of said hydrocarbon cracking reaction zone, wherein said manner of recycling said stripped and regenerated catalyst to said reactor riser is controlled by:

(a) contacting a first portion of said divided regenerated catalyst recylce stream with said hydrocarbonaceous feedstock in said reactor riser at a flow rate of said first portion of regenerated catalyst responsive to a first temperature determined within said reactor riser intermediate said first portion of catalyst admixture with said hydrocarbonaceous feedstock and entry of a second portion of said regenerated catalyst; and (b) contacting a second portion of said regenerated catalyst with said admixture comprising said feedstock and said first portion of regenerated catalyst in said reactor riser at a flow rate of said second portion of regenerated catalyst responsive to a second temperature determined within said hydrocarbon reaction zone situated downstream of said reactor riser containing said first temperature determination point and both said first and second regenerated catalyst recycle entry points.

* * * * *